US005895146A

United States Patent [19]

Waki et al.

[11] Patent Number: 5,895,146

[45] **Date of Patent: *Apr. 20, 1999**

[54] CHARGING DEVICE AND IMAGE FORMING APPARATUS

[75] Inventors: Kenichiro Waki, Susono; Masahiro Itoh, Odawara; Ryo Inoue, Susono, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/780,683

[22] Filed: Jan. 8, 1997

[30] Foreign Application Priority Data

Jan. 10, 1996 [JP] Japan ..... 8-002644

[51] Int. Cl.[6] ..... G03G 15/09

[52] U.S. Cl. ..... 399/170; 399/174; 399/175

[58] Field of Search ..... 399/267, 270, 399/273, 274, 275, 276, 277, 168, 174, 175, 176

[56] References Cited

U.S. PATENT DOCUMENTS

| | | | |
|---|---|---|---|
| 5,177,536 | 1/1993 | Watanabe et al. | 355/251 |
| 5,249,022 | 9/1993 | Watanabe et al. | 355/271 |
| 5,267,007 | 11/1993 | Watanabe et al. | 355/245 |
| 5,287,148 | 2/1994 | Sakemi et al. | 355/245 |
| 5,426,489 | 6/1995 | Haneda et al. | 399/175 |
| 5,438,394 | 8/1995 | Suzuki et al. | 355/251 |
| 5,459,559 | 10/1995 | Nagase et al. | 355/251 |
| 5,576,812 | 11/1996 | Hibino et al. | 355/251 |
| 5,592,264 | 1/1997 | Shigeta et al. | 399/175 |

FOREIGN PATENT DOCUMENTS 6-230647 8/1994 Japan .

*Primary Examiner*—Arthur T. Grimley
*Assistant Examiner*—Hoan Tran
*Attorney, Agent, or Firm*—Fitzpatrick, Cella, Harper & Scinto

[57] ABSTRACT

An image forming apparatus includes a charging device applies a voltage to charge an image bearing member. The charging device is provided with a charging means to which a voltage is applicable to charge said image bearing member, said charging means being provided with a magnetic particle carrying member for carrying and conveying a magnetic particle layer contacting with said image bearing member during the charging operation; a container contains magnetic particles therein; and a replacing device replaces the magnetic particles carried on the magnetic particle carrying member with the magnetic particles contained in the container. A developer develops a latent image produced on the image bearing member by the charging device using a toner to produce a toner image. A transferring device transfers the toner image from the image bearing member simultaneously with developing of the latent image without using a cleaner member after transferring by said transferring device and before charging by said charging device.

10 Claims, 5 Drawing Sheets

CHARGING DEVICE AND IMAGE FORMING APPARATUS

BACKGROUND OF THE INVENTION

1. Field of the Invention

This invention relates to a contact charging device for charging a member to be charged such as an image bearing member mounted in a copying apparatus, a laser beam printer or the like, and an image forming apparatus.

2. Related Background Art

FIG. 4 of the accompanying drawings is a longitudinal cross-sectional view schematically showing the construction of an image forming apparatus according to the prior art. The construction and operation of the image forming apparatus will hereinafter be described briefly with reference to FIG. 4.

An original G is first placed on an original supporting table 11 with the image surface thereof (the surface to be copied) turned downward. When copying is then started, the image surface of the original G is scanned while being irradiated from below it by a unit 12 comprised of an original irradiating lamp, a short-focus lens array, a CCD sensor, etc. constructed integrally with one another. Thereby, the reflected light from the image surface is imaged by the short-focus lens array and enters the CCD sensor. The CCD sensor is comprised of a light receiving portion, a transfer portion and an output portion. In the light receiving portion, an optical signal is converted into a charge signal, and is sequentially transferred to the output portion by the transfer portion in synchronism with a clock pulse, and in the output portion, the charge signal is converted into a voltage signal, which in turn is amplified and made into low impedance and outputted. An analog signal obtained in this manner is subjected to well-known image processing and is converted into a digital signal, which is sent to a printer portion.

In the printer portion, the above-mentioned image signal is received and an electrostatic latent image is formed in the following manner. A photosensitive drum (image bearing member) 1 is rotatively driven in the direction of arrow R1 at a predetermined peripheral velocity (process speed), and the surface thereof is uniformly charged to about −650 V by a charger 2. An electrostatic latent image is formed on the surface of the photosensitive drum 1 after charged, by a laser scanning portion 100. In the laser scanning portion 100, as shown in FIG. 6 of the accompanying drawings, a solid laser element 102 is first turned on and off at predetermined timing by a light emission signal generator 101 on the basis of the inputted image signal to thereby emit a laser beam. The laser beam emitted from the solid laser element 102 is converted into a substantially parallel light beam by a collimator lens system 103 and is further scanned by a rotatable polygon mirror 104 rotated in the direction of arrow (counter-clockwise direction) and also is imaged on the surface of the photosensitive drum 1 by $f\cdot\theta$ lens units 105*a*, 105*b* and 105*c* as indicated by arrow Co in FIG. 6. By the scanning of such a laser beam, an exposure distribution corresponding to one image scan is formed on the surface of the photosensitive drum 1 and further, during each scanning cycle, the surface of the photosensitive drum 1 is scrolled by a predetermined amount in a direction perpendicular to the scanning direction, whereby an electrostatic latent image as an exposure distribution conforming to the image signal is formed on substantially the whole of the surface of the photosensitive drum 1.

The electrostatic latent image is developed by a developing device 3. The developing method is divided broadly into a method of coating a developing sleeve with a non-magnetic toner by a blade or the like, or coating the developing sleeve with a magnetic toner by the magnetic force thereof and conveying the magnetic toner and developing a latent image with the toner in a non-contact state with the photosensitive drum 1 (one-component non-contact development), a method of developing a latent image with the toner coating in the above-described a manner being brought into contact with the photosensitive drum 1 (one-component contact development), a method of using a mixture of toner particles and a magnetic carrier as a developer and conveying the developer by the magnetic force thereof and developing a latent image with the developer in a contact state with the photosensitive drum 1 (two-component contact development), and a method of developing a latent image with the above-mentioned two-component developer in a non-contact state (two-component non-contact development), but the two-component contact developing method is often used from the viewpoints of the high quality and high stability of image.

FIG. 5 of the accompanying drawings schematically show the construction of a developing device for two-component magnetic brush development as an example of the two-component contact developing method. In FIG. 5, the reference numeral 31 designates a developing sleeve for carrying and conveying a developer, the reference numeral 32 denotes a magnet roller fixedly disposed in the developing sleeve 31, the reference numerals 33 and 34 designate agitating screws for agitating the developer, the reference numeral 35 denotes a developing blade for regulating the developer carried on the surface of the developing sleeve 31 into a thin layer, the reference numeral 36 designates a developer container containing the developer therein, and the reference numeral 37 denotes a voltage source for applying a voltage to between the developing sleeve 31 and the photosensitive drum 1. The developing sleeve 31 is disposed relative to the surface of the photosensitive drum 1 so that at least during development, the most proximate area thereof may be about 500 μm, and is set so that development can be accomplished with the developer being in contact with the photosensitive drum 1.

In the two-component developer used in this example of the prior art, titanium oxide of an average particle diameter 20 nm added at 1% by weight to a negatively charged toner of an average particle diameter 6 μm manufactured by the crushing method was used as toner particles, and a magnetic carrier of an average particle diameter 35 μm having saturation magnetization of 205 emu/cm$^3$ was used as the carrier. Also, this toner and this carrier mixed at a weight ratio 6:94 were used as the developer.

Description will now be made of the developing step of visualizing the above-described electrostatic latent image by the two-component magnetic brush method by the use of the above-described developing device 3, and a circulation system for the developer. First, the developer drawn up by a magnetic pole $N_2$ with the rotation of the developing sleeve 31 and carried on the surface of the developing sleeve 31 has its layer thickness regulated by the regulating blade 35 disposed perpendicularly to the surface of the developing sleeve 31, in the course of the developer being conveyed from a magnetic pole $S_2$ to a magnetic pole $N_1$, and is formed as a thin layer on the developing sleeve 31. The developer thus formed as a thin layer is conveyed to a developing main magnetic pole $S_1$ and an electromagnetic brush is formed by a magnetic force. This developer formed in the shape of an electromagnetic brush has its toner caused to adhere to the aforedescribed electrostatic latent image and develops the latent image into a toner image, whereafter the toner and carrier not used for the development are collected from the surface of the developing sleeve 31 into the developer container 36 by the repulsive magnetic field of poles $N_2$ and $N_3$. The developing sleeve 31 has applied thereto from the voltage source a superposed voltage comprising a DC voltage and an AC voltage superposed one upon the other. In this example of the prior art, −500 V is applied as the DC voltage and a peak-to-peak voltage $V_{pp}$=1800 V and a frequency Vf=2000 Hz are applied as the AC voltage. Generally in the two-component developing method, when an AC voltage is applied, the developing effect increases and the quality of image becomes high.

The toner image formed on the photosensitive drum 1 in this manner is electrostatically transferred onto a transfer material such as paper by a transfer charger 4*a* shown in FIG. 4. After the transfer of the toner image, the transfer material is electrostatically separated from the surface of the photosensitive drum 1 by a separating charger 4*b* and conveyed to a fixating device 6, where the toner image is heat-fixated and outputted. On the other hand, after the transfer of the toner image, the photosensitive drum 1 has an adhering contaminant such as untransferred toner on its surface removed by a cleaner 5, and has its charges removed by a charge removing lamp and is used for the next image formation.

In the above-described construction, the charger 2 is a corona charger, but contact charging systems (such as magnetic brush charging, fur brush charging and roller charging) have come to be used with a view to suppress the creation of ozone by corona discharging and with a view to achieve a higher quality of image such as being free of wire contamination. Also as to the transfer charger 4*a*, there are various types including a transfer roller, but basically, as described above, an image is formed by a series of processes such as charging, exposure, development, transfer, fixation and cleaning.

Now, in recent years, the downsizing of image forming apparatuses has progressed, but there has been a limit to the downsizing of the apparatuses by achieving the downsizing of only the instruments for effecting the above-mentioned series of processes such as charging, exposure, development, transfer, fixation and cleaning. The aforementioned untransferred toner is collected by the cleaner 5, but it is preferable from the viewpoint of environmental protection that such waste toner be absent.

So, there has appeared a cleanerless image forming apparatus in which the above-described cleaner 5 is removed and development and cleaning are effected at a time by the developing device 3. Development and cleaning at a time is a method of collecting some untransferred toner remaining on the photosensitive drum after transfer by a defogging potential difference $V_{back}$ which is the potential difference between the DC voltage applied to the developing device 3 and the surface potential of the photosensitive drum 1 during the development after the next step. According to this method, the untransferred toner is collected and reused after the next step and therefore, waste toner can be eliminated. Also, the absence of the cleaner means an advantage in terms of space, and the downsizing of the entire image forming apparatus becomes possible.

However, when in the above-described image forming apparatus, the cleaner 5 was eliminated and development and cleaning at a time were attempted, the positive ghost of the preceding image was created in a portion free of the image at the period of rotation of the photosensitive drum 1. This positive ghost is a phenomenon occurring with the toner transferred to a portion which originally is a white ground portion because the untransferred toner of the preceding image could not be collected in the developing area. In contrast with this, a contact charging member is used as a charging member and a voltage is applied thereto, whereby it becomes possible to erase the history of the untransferred toner remaining in the state of the preceding image and discharge it onto the photosensitive drum in a uniform state. Therefore, the toner discharged onto the thin layer becomes advantageous in the collectability during development and the fault of image becomes preventable.

However, when outputting was effected by the use of the contact charging member as described above, good images were obtained on several sheets, but when several thousand sheets were supplied, there occurred unsatisfactory charging due to the contamination of the contact charging member by the toner.

Also, the reduction in the charging property due to the contamination of the contact charging member is a problem which causes the formation of bad images not only in the case of the development and cleaning at a time as described above, but also when a special cleaner as shown in FIG. 4 is provided.

SUMMARY OF THE INVENTION

It is an object of the present invention to provide a charging device and an image forming apparatus in which the occurrence of unsatisfactory charging due to the contamination of a charging member by a toner is prevented.

It is another object of the present invention to provide a charging device and an image forming apparatus in which any toner mixing with a charging member is removed.

DESCRIPTION OF THE PREFERRED EMBODIMENTS

Some embodiments of the present invention will hereinafter be described with reference to the drawings.

Embodiment 1

Figure 2:
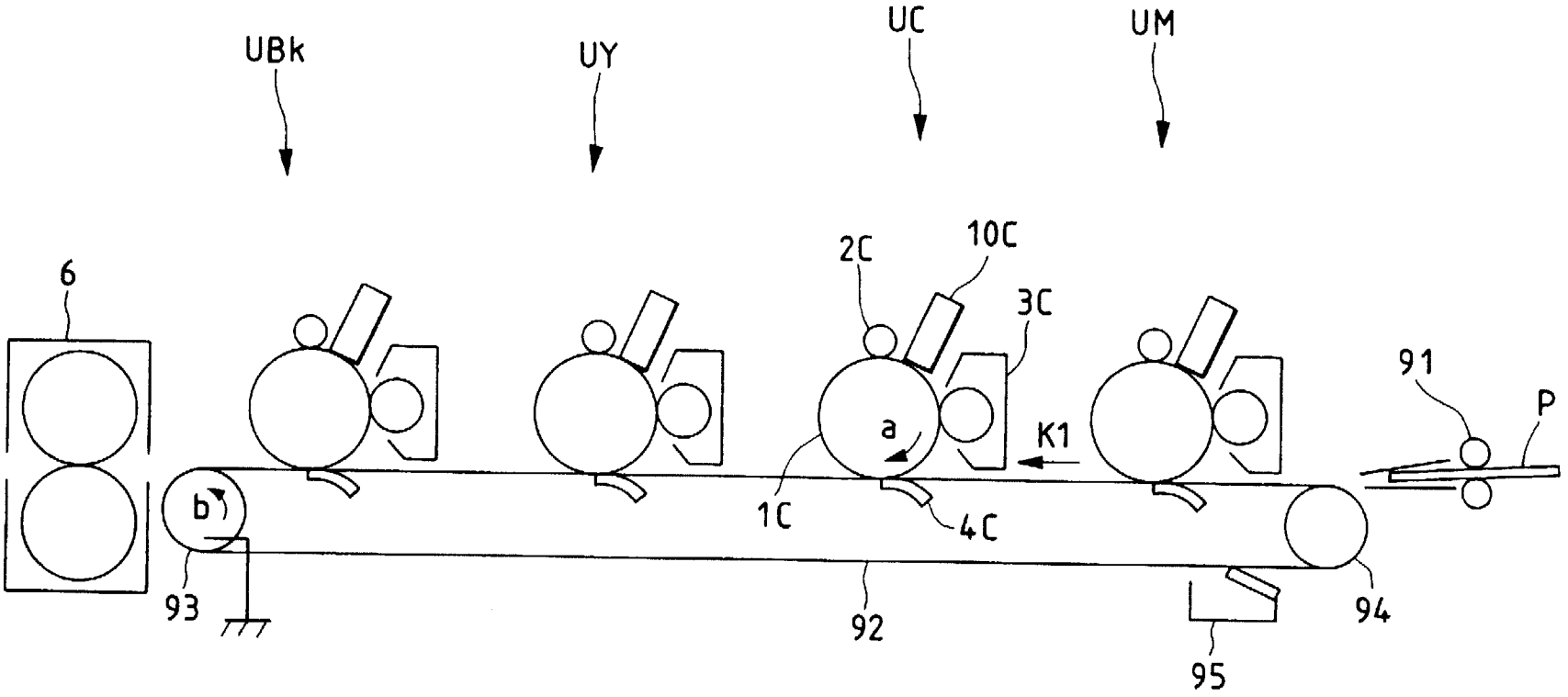
FIG. 2 is a longitudinal cross-sectional view schematically showing the construction of an image forming apparatus according to Embodiment 1 of the present invention.
Figure 4:
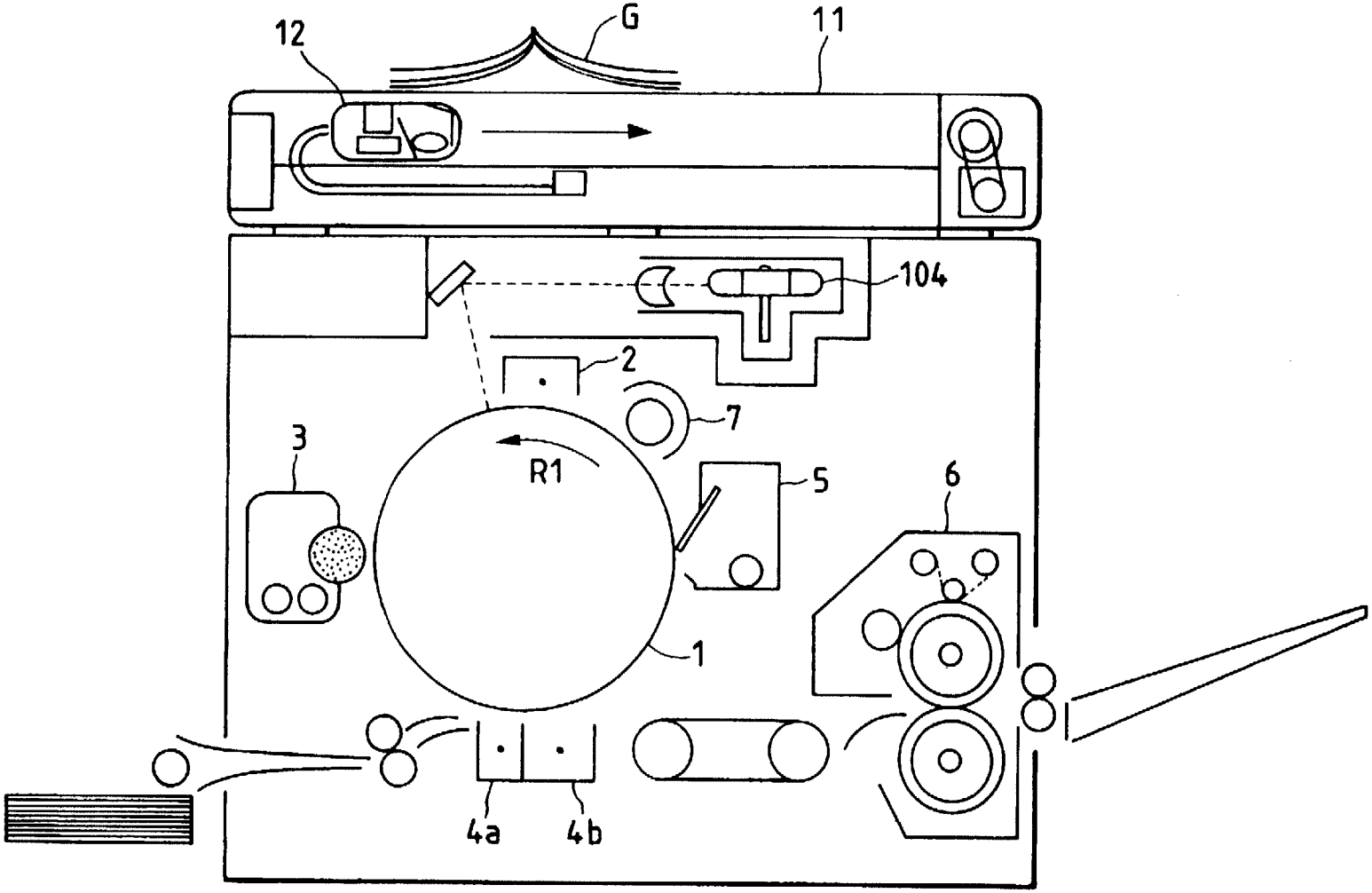
FIG. 4 PRIOR ART
FIG. 4 is a longitudinal cross-sectional view schematically showing the construction of an image forming apparatus according to the prior art.

FIG. 2 is a longitudinal cross-sectional view schematically showing the construction of an image forming apparatus according to the present invention. The image forming apparatus shown in FIG. 2 is provided with a plurality of image forming units and transfer material conveying means (a transfer belt) disposed so as to extend through these image forming units, and uses as a toner a spherical toner formed by the polymerizing method, and also adopts an image forming process in which untransferred toner is collected simultaneously with development without a cleaner. The apparatus will hereinafter be described.

The image forming apparatus is provided with four image forming units UM, UC, UY and UBk for forming magenta, cyan, yellow and black toner images, respectively, in succession from the upstream side along the conveyance direction (the direction of arrow K1) of a transfer material P such as paper. These four image forming units are similar in construction and function and therefore, their construction and operation will hereinafter be described with the cyan image forming unit UC taken as an example.

The image forming unit UC is provided with a drum type electrophotographic photosensitive member (hereinafter referred to as the photosensitive drum) 1C as an electrostatic latent image bearing member. It is to be understood that when it is not necessary to distinguish between the photosensitive drums of the respective image forming units, the photosensitive drum is simply referred to as the "photosensitive drum 1". The photosensitive drum 1C is rotatably supported and is rotatively driven in the direction of an arrow by drive means (not shown). Around the photosensitive drum 1C, there is disposed a primary charger (contact charging device) 2C, an exposure device (exposure means) 10C, a developing device (developing means) 3C and a transfer device (transfer means) 4C in succession along the direction of rotation thereof.

The primary charger 2C is disposed in contact with the surface of the photosensitive drum 1C. The primary charger 2C has a non-magnetic charging sleeve having a fixed magnet therein, and magnetic particles having volume resistance of the order of $10^7\Omega$·cm and a particle diameter of 25 μm (hereinafter referred to as the "charged magnetic particles") are carried on the surface of the charging sleeve. The magnetic particles rotate while contacting with the surface of the photosensitive drum 1C, with the rotation of the charging sleeve. Further, an AC bias of a peak-to-peak voltage 700 V on which a DC voltage −650 V is superposed is applied to the charging sleeve, whereby the surface of the photosensitive drum 1C is charged to predetermined potential. The primary charger 2C will be described later in detail. The surface of the photosensitive drum 1C after charged is subjected to exposure corresponding to the image of an original G by the exposure device 10C such as an LED (light emitting diode), whereby an electrostatic latent image is formed on the surface of the photosensitive drum 1C.

The developing device 3C contains therein a negatively charged toner produced by the polymerizing method as a developer. As the developing device 3C, use is made of one similar to the example of the prior art described with reference to FIG. 5, and the description thereof is omitted. The transfer device 4C is provided with a transfer blade having elasticity. The transfer blade is formed of a semiconductor of a resistance value of $10^9$ to $10^{11}\Omega$·cm as a basic material, and upwardly biases the back of a transfer belt 92 which will be described later to thereby urge the surface of the transfer belt 92 against the surface of the photosensitive drum 1C.

The transfer belt 92 is extended between a drive roller 93 rotatively driven in the direction of arrow b and a follower roller 94, and the tensioned side thereof (the upper side as viewed in FIG. 2) is moved in the direction of arrow K1. The transfer belt 92 is an endless belt formed of electrically conductive particles of carbon or the like dispersed in a basic material of resin such as polycarbonate having predetermined mechanical strength and flexibility or rubber, and may preferably be one of which the resistance value is adjusted to $10^8$ to $10^{13}\Omega$·cm and the thickness is 0.1 to 1 mm. The transfer belt 92 is disposed so as to extend through the aforementioned four image forming units UM, UC, UY and UBk, and carried the transfer material P on the surface thereof and conveys it in the direction of arrow K1. A cleaning device 95 is disposed in contact with the transfer belt 92, whereby materials adhering to the surface of the transfer belt are removed.

In FIG. 2, a paper feeding roller 91 for feeding the transfer material P to the transfer belt 92 is disposed on the upstream side of the transfer belt 92, and a fixating device 6 for fixating magenta, cyan, yellow and black toner images transferred onto the transfer material P is disposed on the downstream side of the transfer belt 92.

The above described members will be further described in detail.

The photosensitive drum 1C is constructed by providing five functional layers, i.e., first to fifth layers, in succession from the inside on the surface of a drum base member of aluminum which is in the form of a cylinder having a diameter of 30 mm. The first layer 1*a* is an underlying layer comprising an electrically conductive layer having a thickness of 20 μm, and prevents the creation of the moire by the reflection of exposure. The second layer 1*b* is a positive charge introduction preventing layer which plays the role of preventing position charges poured from the drum base member from negating negative charges charged on the surface of the photosensitive drum 1C, and is a medium resistance layer of a thickness of about 0.1 μm of which the resistance is adjusted to the order of $10^6\Omega$·cm by Amylan resin and methorymethyl nylon. The third layer 1*c* is a charge creating layer which is a layer of a thickness of about 0.3 μm in which a pigment of the diazo origin is resin-dispersed, and creates pairs of positive and negative charges by exposure. The fourth layer 1*d* is a charge transport layer formed of hydrazone dispersed in polycarbonate resin, and is a p-type semiconductor (OPC). As the fifth layer 1*e*, provision is made of a surface layer of 2 μm formed of Teflon (trade name: trade mark PTFE of DuPont, Inc.) and resistance particles of $SnO_2$ or the like for reducing the surface resistance dispersed in polycarbonate resin.

The surface resistance of the photosensitive drum 1C constructed of the above-described five layers is $10^{13}\Omega$·cm. By the surface resistance being thus adjusted, direct chargeability is improved and images of high quality can be obtained. The photosensitive drum 1C is not restricted to OPC, but can also be formed by a-Si (amorphous silicon). In this case, higher durability can be realized. It is preferable that the volume resistivity of the surface layer 1*e* be $10^9$ to $10^{14}\Omega$·cm.

In the present invention, a toner of which the shape coefficient SF-1 is 100 to 300 and the shape coefficient SF-2 is 100 to 115 is suitably used. SF-1 and SF-2 indicative of the shape coefficients are defined as values obtained by sampling 100 toner images at random by the use of FE-SEM (S-800) produced by Hitachi Works, Ltd., introducing the image information thereof into an image analyzing apparatus (Luzex 3) produced by Nikore Ltd. through an interface and effecting an analysis, and calculating it from the following expressions:

$$SF\text{-}1=\{(MXLNG)^2/AREA\}\times(\pi/4)\times 100$$

$$SF\text{-}2=(PERI/AREA)\times(1/4\pi)\times 100.$$

where AREA: toner projection area,

MXLNG: absolute maximum length,

PERI: peripherical length.

The shape coefficient SF-1 of the toner indicates the degree of sphericity, and if it is greater than 140, a change gradually occurs from the sphericity to an indefinite shape. On the other hand, SF-2 indicates the degree of unevenness, and if it is greater than 120, the unevenness of the surface of the toner becomes remarkable. The operational effect of the shape of the toner is to weaken the influence of the contact charging member on the surface of the toner as far as possible and suppress the production of a reactive low molecular amount component in the toner. That is, a spherical shape in which the surface area of the toner is as small as possible is preferable.

The use of a toner of which part or the whole was formed by the polymerizing method can enhance the effect of the present invention. Particularly as regards a toner of which such a surface portion was formed by the polymerizing method, it is caused to exist as pre-toner (monomer composition) particles in a dispersion medium and the necessary portion is produced by polymerizing reaction and therefore, there can be obtained a toner of which the surface property is considerably smoothed. If SF-1 exceeds 140 or SF-2 exceeds 120, fog may increase and durability may become somewhat inferior.

Further, by using a toner which is made to have core/shell structure and in which the shell portion was formed by polymerization, it is possible to more easily manufacture the toner used in the image forming method of the present invention. In this sense, the toner having the core/shell structure is preferably used in the present invention. The advantage of the core/shell structure resides in that a blocking resisting property can be imparted without spoiling the excellent fixating property of the toner. The volume average particle diameter of the toner is preferably 4 to 15 μm. Here, as the volume average particle diameter of the toner, use can be made, for example, one measured by the following measuring method.

Coletar, counter TA-II type (produced by Coletar Inc.) is used as a measuring apparatus, and an interface (produced by Nikkaki Co., Ltd.) outputting an individual number average distribution and a volume average distribution and CX-i personal computer (produced by Canon Inc.) are connected together, and as regards the electrolyte, 1% NaCl water solution is adjusted by the use of first-class sodium chloride.

As a measuring method, 0.1 to 5 ml of an interfacial active agent (preferably alkylbensulfonic acid salt) is added as a dispersing agent to 100 to 150 ml of the electrolyte water solution, and a measurement sample of 0.5 to 50 mg is further added. The electrolyte in which the sample is suspended is subjected to a dispersing process by an ultrasonic dispersing device for about 1 to 3 minutes, and by the aforementioned Coletar counter TA-II type, the particle size distribution of particles of 2 to 40 μm is measured with an aperture of 100 μm used as the aperture to thereby find a volume distribution. By the thus found volume distribution, the volume average particle diameter of the sample is obtained.

Further, it is desirable to adopt such a construction that the surface of the toner is covered with an extraneous additive to thereby permit some of the influence of the contact charging member to escape to the extraneous additive. It is preferable that the extraneous additive used in the present invention be of a particle diameter of 1/10 or less of the weight average diameter of the toner particles from the viewpoint of the durability when it is added to the toner. The particle diameter of this additive means the average particle diameter thereof found by the observation of the surface of the toner particles in an electronic microscope. As the extraneous additive, use may be made of the following materials:

a metal oxide (such as aluminum oxide, Titanium oxide, strontium titanate, cerium oxide, magnesium oxide, chromium oxide, tin oxide or zinc oxide), a nitride (such as silicon nitride), a carbide (silicon carbide), metallic salt (such as calcium sulfate, barium sulfate or calcium carbonate), fatty acid metallic salt (such as zinc stearate or calcium stearate), carbon black, silica or the like. The extraneous additive is used by 0.01 to 10 parts by weight for 100 parts by weight of toner particles, and preferably by 0.05 to 5 parts by weight. These extraneous additives may be used singly or in plurality. Extraneous additives subjected to the hydrophobic process are more preferable.

As the charged magnetic particles, the following would occur to mind:

(i) resin and magnetic powder such as magnetite kneaded together and shaped into particles, or electrically conductive carbon or the like mixed therewith for the adjustment of the resistance value;

(ii) sintered magnetite or ferrite, or these reduced or oxidized to adjust the resistance value; or (iii) the above-mentioned magnetic particles coated with a coating material adjusted in resistance (such as carbon dispersed in phenol resin) or plated with a metal such as Ni to adjust the resistance value to a suitable value. If the resistance value of these magnetic particles is too high, charges cannot be uniformly poured into the photosensitive drum 1C and a fogged image by minute unsatisfactory charging will be formed. If conversely, the resistance value is too low, when there is a pinhole in the surface of the photosensitive drum 1C, the electric current will concentrate in the pinhole and the charging voltage will drop and the surface of the photosensitive drum cannot be charged, and there will be provided charged-nip-like unsatisfactory charging. Consequently, the resistance value of the magnetic particles may be $1\times10^{2}$ to $1\times10^{10}\Omega$, and preferably $1\times10^{6}\Omega$ or greater when the presence of something like a pinhole in the surface of the photosensitive drum is taken into account. The resistance value of the charged magnetic particles was measured putting 2 g of charged magnetic particles into a metallic all (having a bottom area of 228 $mm^2$) to which a voltage could be applied, and thereafter weighting it and applying a voltage of 100 V to it.

As the magnetic characteristic of the charged magnetic particles, it is better to make the magnetic restraining force high in order to prevent the adherence of the particles to the photosensitive drum 1C, and it is desirable that saturation magnetization be 100 ($emu/cm^3$) or greater. The charged magnetic particles actually used in the present embodiment was 30 μm in average particle diameter, $1\times10^{6}\Omega$ in resistance value and 200 ($emu/cm^3$) in saturation magnetization.

Figure 5:
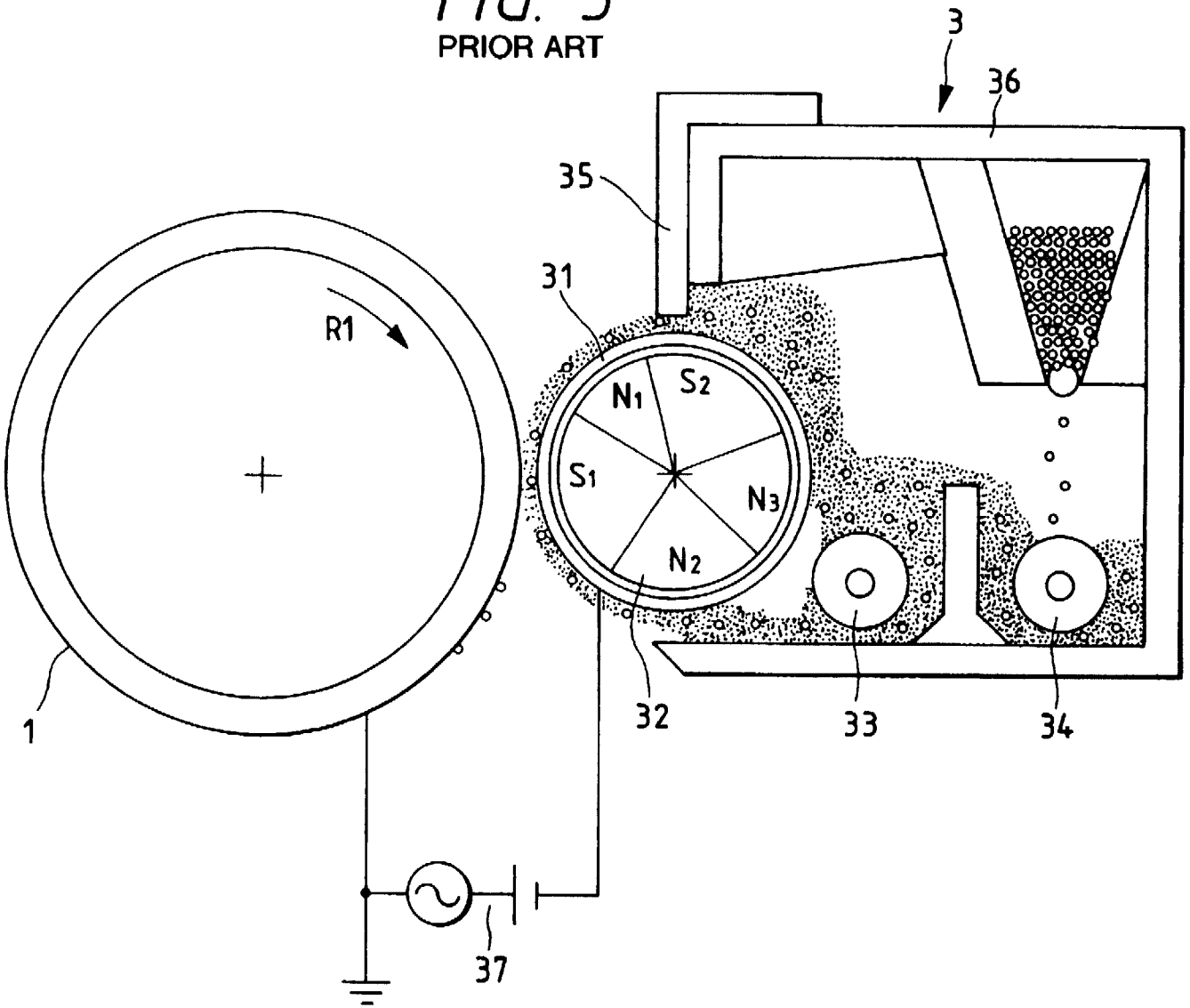
FIG. 5 PRIOR ART
FIG. 5 is a longitudinal cross-sectional view schematically showing the construction of a developing device according to Embodiments 1 and 2 and the prior art.
Figure 6:
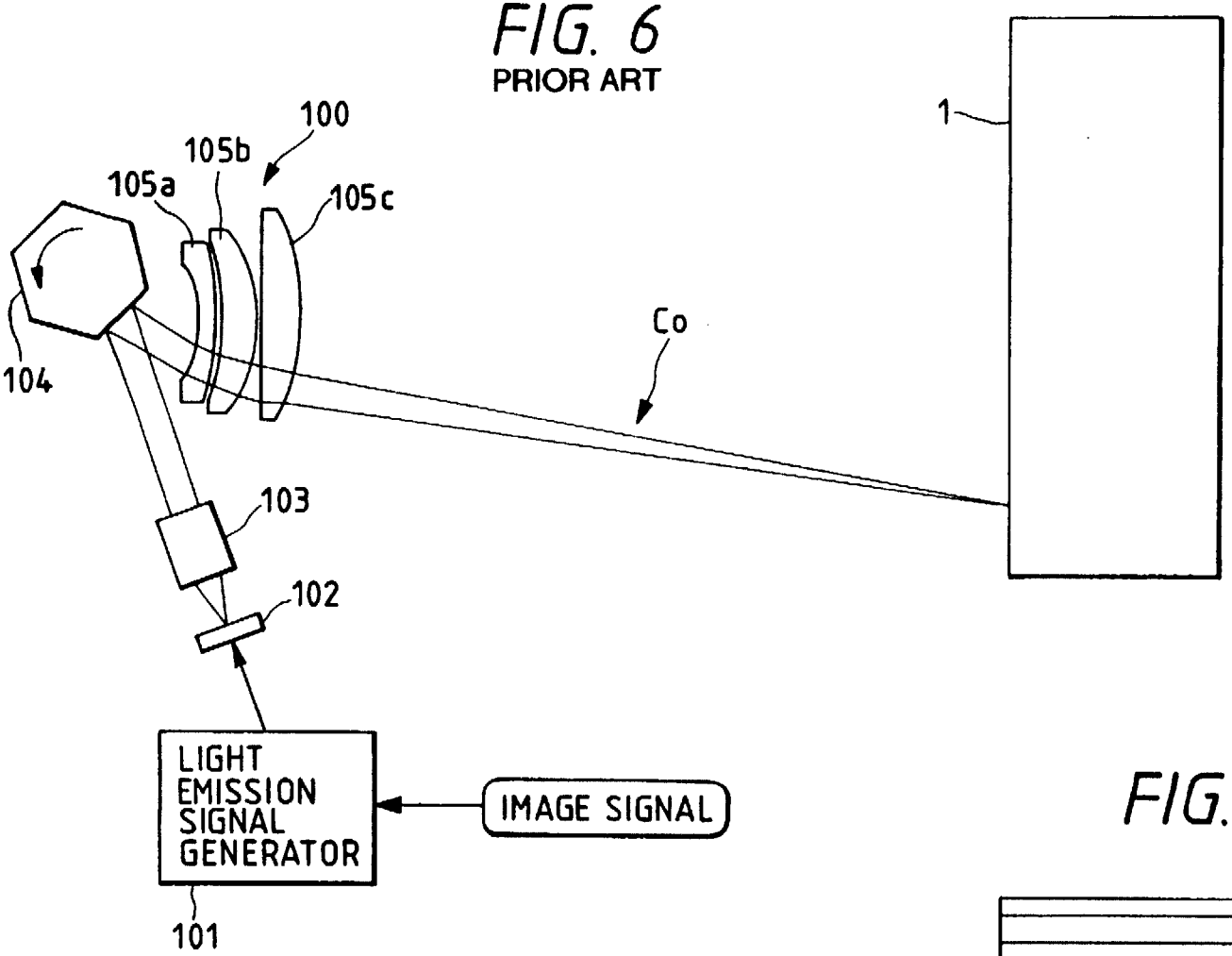
FIG. 6 PRIOR ART
FIG. 6 schematically shows a laser scanning portion.
Figure 7:
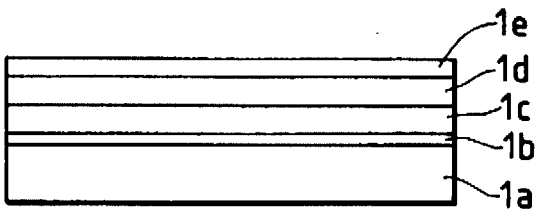
FIG. 7 is a cross-sectional view showing the layer construction of a photosensitive member.

A DC voltage and an AC voltage are applied from a voltage source 37 to a developing sleeve 31 shown in FIG. 5, and in the present embodiment, a DC voltage of −500 V and an AC voltage of which the peak-to-peak voltage is $V_{pp}$=1800 V and the frequency is Vf=2000 Hz are applied in superposed relationship with each other.

In the present embodiment, there is realized a so-called cleanerless apparatus in which use is made of a spherical toner having very good transfer efficiency, whereby any special cleaner is eliminated and development and cleaning at a time are effected by the developing device 3.

Some untransferred toners are left on the respective photosensitive drums 1 of the image forming units UM, UC, UY and UBk after the transfer step has been terminated. In the following, as in the foregoing, description will be made with the image forming unit UC taken as an example. In the minute amount of untransferred toner on the image forming unit UC, particles of positive polarity and negative polarity are mixedly present due to the discharging during transfer. These mixedly present toner particles are conveyed to the primary charger 2C, but as previously described, the primary charger 2C is such that magnetic particles of volume resistivity of the order of $10^7\Omega$·cm and particle diameter of 25 μm are carried on the surface of the non-magnetic sleeve containing a fixed magnet therein and having a negative voltage applied thereto, and these magnetic particles are rotating while contacting with the photosensitive drum 1C, and the untransferred toner mixes with these magnetic particles and the untransferred toner is all charged to the negative polarity and is blown out onto the photosensitive drum 1C. The untransferred toner of which the polarity has been uniformized to the negative in the primary charging step and blown out onto the photosensitive drum 1C is collected into the developing device 3C by the defogging electric field during development.

Here, the development and collection at a time by the developing device 3C are effected simultaneously with the other image forming steps (charging, exposure, development and transfer) when the image area in the direction of rotation is longer than the peripheral length of the photosensitive drum 1C. That is, the photosensitive drum 1 on which untransferred toner is present is charged and exposed to thereby form a latent image thereon, and the developing bias between the high potential and the low potential of the latent image is applied to the developing sleeve, whereby the toner is developed from the developing sleeve to the low potential portion and at the same time, the toner is collected from the high potential portion to the developing sleeve. This cleanerless apparatus can adopt the construction of a system which uses the contact type primary charger 2C as in the present embodiment to thereby once introduce the untransferred toner into the primary charger 2C and then cause the photosensitive drum 1C to discharge it.

According to such a system, even when a very great deal of untransferred toner is unexpectedly created, the primary charger 2C acts as a buffer and therefore, it does not happen that the great deal of toner to be collected is conveyed to the developing device 3C and causes unsatisfactory collection of the toner. By using contact charging, particularly the primary charger 2C using magnetic particles like that of the present embodiment, there can be realized a cleanerless system of higher dignity. Further, this system adopts a pouring charging system in which charges are poured into the trap potential of the surface material of the photosensitive drum by the contact charging member to thereby effect charging or a charge pouring layer having electrically conductive particles dispersed is provided on the surface of the photosensitive drum and these electrically conductive particles are charged by the contact charging member to thereby effect charging and therefore, the amount of discharge when the photosensitive drum is charged is very small.

Figure 1:
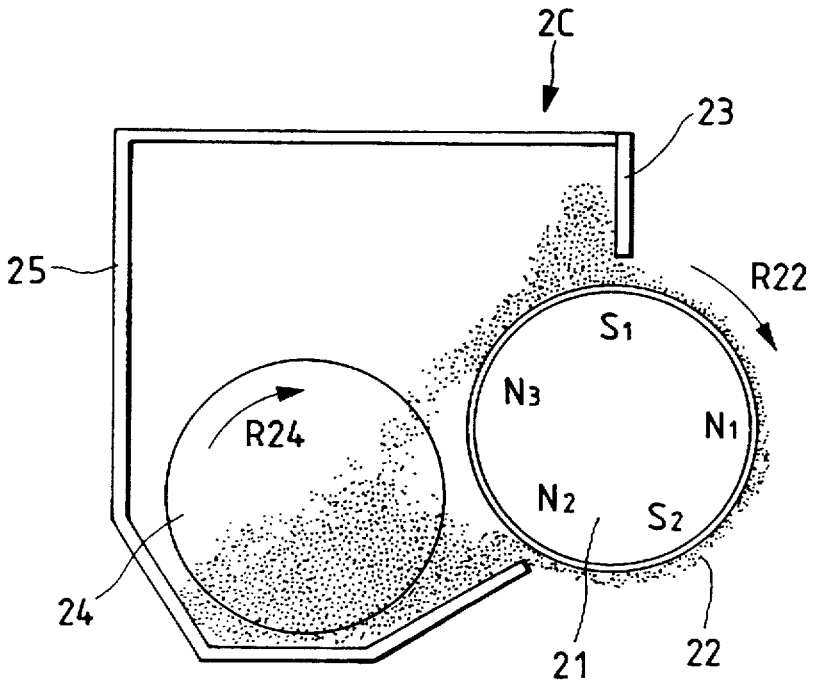
FIG. 1 is a longitudinal cross-sectional view schematically showing the construction of a contact charging device according to Embodiment 1 of the present invention.

When the contamination of the charged magnetic particles by the toner which was a problem peculiar to the example of the prior art was examined, it was found that the charged magnetic particles were toner-contaminated by the share in the regulating portion for the charged magnetic particles. The present invention intends to suppress such toner contamination. The primary charger (contact charging device) 2C which is a main constituent of the present invention will now be described with reference to FIG. 1.

The primary charger 2C is of such a construction having a charging sleeve 22 and an agitating member 24 in a charging container 25. A magnet 21 is fixedly disposed inside the charging sleeve 22. Above the magnetic pole $S_1$ of this magnet 21, a regulating blade 23 is disposed with a gap of 800 μm with respect to the surface of the charging sleeve 22, and the surface of the charging sleeve 22 is coated with a thin layer of charged magnetic particles collecting on that side of this regulating blade 23 which is adjacent to the charging container 25. The charging sleeve 22 is rotated in the direction of arrow R22, and the charged magnetic particles carried on and conveyed by the surface of the charging sleeve 22 contact with the photosensitive drum 1C at a magnetic pole $N_1$, whereby charging is effected. The charged magnetic particles having passed through this nip pass through a magnetic pole $S_2$ for conveyance and are peeled from the surface of the charging sleeve 22 by a repulsing pole (magnetic particle replacing means) comprised of magnetic poles $N_2$ and $N_3$ of the same polarity adjacent to each other in the charging container 25. The charged magnetic particles thus peeled are agitated by the agitating member 24 rotated in the direction of arrow R24 and are again carried on the surface of the charging sleeve 22 by the magnetic force of the magnetic pole $N_3$. It should be noted that a certain degree of amount of charged magnetic particles collects inside the regulating blade 23 above the magnetic pole $S_1$.

The primary charger 2C is constructed as described above and forms a magnetic brush as a whole. The charging by such a magnetic brush can also be effected by a construction which does not use the regulating blade 23 as used in the above-described construction but coats the charging sleeve 22 with an amount of charging magnetic particles corresponding to one round of the charging sleeve 22, but if design is made such that a rather great amount of charged magnetic particles is carried in the charging container 25 and is regulated by the above-described regulating blade 23, even when charged magnetic particles leak more or less, the amount of coating will not change and the stability of the nip portion between the charged magnetic particles and the photosensitive drum 1C will be obtained. Also, in the case of the cleanerless apparatus as in the present embodiment, much untransferred toner mixes with the charged magnetic particles and therefore, there occurs the contamination of the charged magnetic particles by the toner. This contamination, as a matter of course, ought to decrease per unit amount as the amount of charged magnetic particles becomes greater.

However, this contamination of the charged magnetic particles by the toner occurs by the share in the pool upstream of the regulating blade 23 and therefore, if the amount of charged magnetic particles is increased, the amount of pool will increase and conversely the share will increase and the contamination will not be bettered. The present invention solves this problem.

As previously described, according to the present embodiment, the charged magnetic particles carried on the charging sleeve 22 are peeled and held in the charging container 25, and the charged magnetic particles contained in the charging container 25 replace the charged magnetic particles on the charging sleeve 22. By doing so, the amount of charged magnetic particles can be increased without increasing the amount of pool upstream of the regulating blade 23, and the contamination of the charged magnetic particles by the toner can be suppressed and even if the charged magnetic particles leak more or less, the amount of coating will not change and the stability of the nip portion between the charged magnetic particles and the photosensitive drum 1C can be improved.

The present construction is of the type in which development and cleaning are effected at a time and therefore, the untransferred toner is collected by the developing device and is used in the subsequent steps and thus, waste toner can be made null. Also, the advantage in terms of space is great and the apparatus can be greatly downsized. Further, images are not deteriorated even by an image forming operation for many sheets and images of high quality can be obtained.

Also, the present construction is of the type in which development and cleaning are effected at a time, but even when a cleaner is present, more or less toner and paper powder slip through the cleaner and mix with the charger. Again in such a case, the application of the present embodiment can provide a substantially similar effect. Further, when the magnetic particles on the charging sleeve 22 are to be replaced with fresh ones, as compared with a case where the magnetic particles on the charging sleeve 22 are not replaced with fresh ones, the pattern of the untransferred toner of the preceding image can be more reliably prevented from remaining as a memory even in the next image.

Embodiment 2

Figure 3:
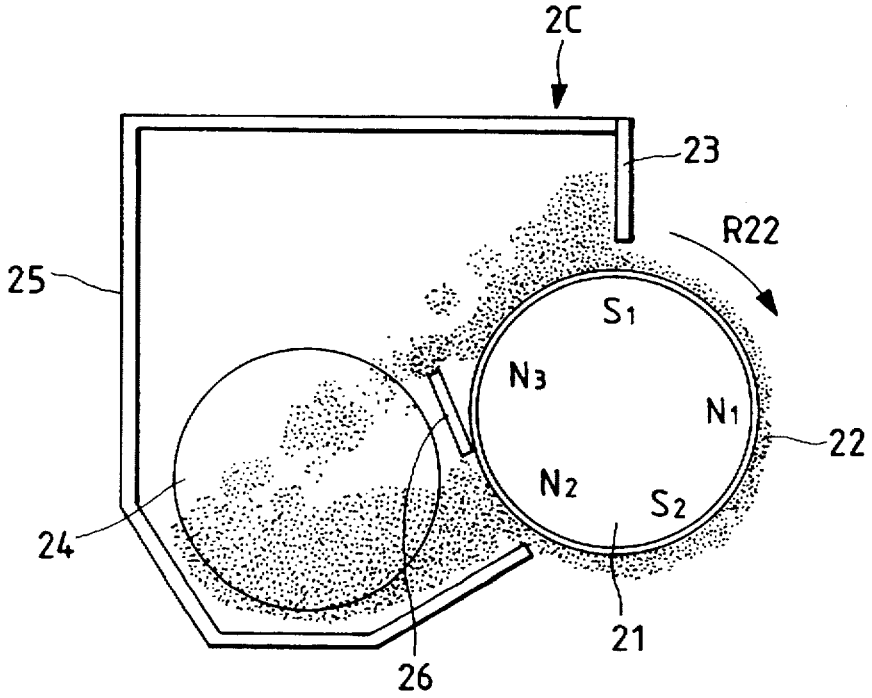
FIG. 3 is a longitudinal cross-sectional view schematically showing the construction of a contact charging device according to Embodiment 2 of the present invention.

Embodiment 2 of the charging device of the present invention will now be described with reference to FIG. 3.

In the above-described Embodiment 1, the charged magnetic particles carried on the charging sleeve 22 are peeled by the magnetic poles $N_2$ and $N_3$ of the same polarity adjacent to each other in the charging container 25, while in Embodiment 2, a thin plate-like scraper (magnetic particle replacing means) 26 is added thereto and is caused to bear against the surface of the charging sleeve 22 so as to peel the charged magnetic particles from the surface of the charging sleeve 22. As shown in FIG. 3, the scraper 26 is caused to bear against the surface of the charging sleeve 22 between the magnetic poles $N_2$ and $N_3$ on the charging sleeve 22 in the charging container 25, whereby the charged magnetic particles on the surface of the charging sleeve 22 are peeled. In this position, coupled with the action of the repulsing poles of the magnetic poles $N_2$ and $N_3$ of the magnet 21, the peeling of the charged magnetic particles by the scraper 26 is effected well.

Embodiment 2 is similar to Embodiment 1 except for the construction of the scraper. Also, Embodiment 2 has repulsing poles which are the magnetic poles $N_2$ and $N_3$, but the repulsing poles need not always be provided when the scraper is provided as in the present construction. Further, in both of Embodiment 1 and Embodiment 2, the charging sleeve 22 has a magnet 21 fixedly disposed therein, but instead of this magnet, a magnet may be rotated to thereby carry and convey the charged magnetic particles, whereby it is possible to charge the surface of the photosensitive drum 1C. In this case, the scraper 26 as in Embodiment 2 becomes more effective. Also, the magnet may be rotated and the sleeve 22 may be fixed.

As described above, the image bearing member is frictionally contacted by the magnetic particles carried on and conveyed by the charging sleeve and also the surface of the image bearing member is uniformly charged, and the magnetic particles used for the charging are ones peeled in the container by the magnetic particle replacing means and instead of this, fresh magnetic particles contained in the container are carried on and conveyed by the charging sleeve to thereby effect the next charging and therefore, it is possible to effectively prevent unsatisfactory charging attributable to the contact charging device being contaminated by the untransferred toner mixed with the magnetic particles during the charging. Also, it is possible to prevent unsatisfactory image formation attributable to unsatisfactory charging caused by the contact charging device being contaminated by the untransferred toner.

What is claimed is:

1. An image forming apparatus comprising:

an image bearing member;

a charging device for charging said image bearing member, said charging device including:

(i) charging means to which a voltage is applicable to charge said image bearing member, said charging means being provided with a magnetic particle carrying member for carrying and conveying a magnetic particle layer contacting with said image bearing member during the charging operation;

(ii) a container containing magnetic particles therein and being disposed partially about said charging means;

(iii) replacing means, provided in said container, for replacing the magnetic particles carried on said magnetic particle carrying member with the magnetic particles contained in said container; and developing means for developing an electrostatic image produced on said image bearing member by said charging device by a toner to produce a toner image, said developing means cleaning a residual toner from said image bearing member simultaneously with developing of the electrostatic image.

2. An image forming apparatus according to claim 1, wherein said charging means is provided with a magnet having a plurality of magnetic poles inside said magnetic particle carrying member.

3. An image forming apparatus according to claim 2, wherein said replacing means is provided with two magnetic poles of the same polarity adjacent to each other, of said plurality of magnetic poles.

4. An image forming apparatus according to claim 3, wherein said replacing means is provided with a scraper for scraping the magnetic particles from said magnetic particle carrying member, said scraper is provided near said two magnetic poles in said container.

5. An image forming apparatus according to claim 1, wherein said replacing means is provided with a scraper for scraping the magnetic particles from said magnetic particle carrying member, said scraper is provided in said container.

6. An image forming apparatus according to claim 2 or 3, wherein said magnetic particle carrying member is a rotatable member and said magnet is a non-rotatable member.

7. An image forming apparatus according to claim 1, said charging device further including a regulating member for regulating the thickness of said magnetic particle layer.

8. An image forming apparatus according to claim 1, wherein said image bearing member is provided with a charge injecting layer provided on the surface thereof and into which charges are injected through the portion of contact between said magnetic particles layer and said image bearing member.

9. An image forming apparatus according to claim 3 or 4, wherein said charging device further including mixing means for mixing the magnetic particles, wherein said mixing means is provided between said two magnetic poles in a direction in which the magnetic particles are carried by said magnetic particle carrying member.

10. An image forming apparatus according to claim 4, said scraper is provided between said two magnetic poles in a direction in which said magnetic particles are carried by said magnetic particle carrying member.

* * * * *

UNITED STATES PATENT AND TRADEMARK OFFICE

CERTIFICATE OF CORRECTION

PATENT NO. : 5,895,146

DATED : April 20, 1999

INVENTOR(S) : KENICHIRO WAKI, ET AL.

It is certified that error appears in the above-identified patent and that said Letters Patent is hereby corrected as shown below:

COLUMN 1,
Line 43, "charged," should read --having been charged--.

COLUMN 2,
Line 8, "a" should be deleted.

COLUMN 5,
Line 46, "charged" should read --having been charged--.

COLUMN 6,
Line 18, "above described" should read --above-described--.

COLUMN 7,
Line 18, "Particularly" should read --Particularly,--.

COLUMN 8,
Line 7, "Titanium" should read --titanium--.

COLUMN 12,
Line 46, "said" should read --and said--;

UNITED STATES PATENT AND TRADEMARK OFFICE

CERTIFICATE OF CORRECTION

PATENT NO. : 5,895,146

DATED : April 20, 1999

INVENTOR(S) : KENICHIRO WAKI, ET AL.

It is certified that error appears in the above-identified patent and that said Letters Patent is hereby corrected as shown below:

COLUMN 12 (Cont.),
Line 51, "said" should read --and said--;
Line 56, "including" should read --includes--; and
Line 65, "including" should read --includes--.

COLUMN 13,
Line 4, "said" should read --wherein said--.

Signed and Sealed this

Twelfth Day of October, 1999

*Attest:*

Q. TODD DICKINSON

*Attesting Officer*

*Acting Commissioner of Patents and Trademarks*